United States Patent [19]

Morris et al.

[11] Patent Number: 4,698,143

[45] Date of Patent: Oct. 6, 1987

[54] STRUCTURAL FRAME FOR AN ELECTROCHEMICAL CELL

[75] Inventors: Gregory J. E. Morris, Lake Jackson; H. Gene Newton, Baytown, both of Tex.

[73] Assignee: The Dow Chemical Company, Midland, Mich.

[21] Appl. No.: 878,457

[22] Filed: Jun. 25, 1986

[51] Int. Cl.[4] ..... C25B 9/00; C25B 11/02; C25B 11/10; C25B 13/00

[52] U.S. Cl. ..... 204/253; 204/254; 204/255; 204/257; 204/279; 204/290 R; 204/290 F

[58] Field of Search ..... 204/279, 252-258, 204/263-266, 286, 290 R, 290 F

[56] References Cited

U.S. PATENT DOCUMENTS

| | | | |
|---|---|---|---|
| 3,849,279 | 11/1974 | Barkel | 204/254 |
| 3,948,750 | 4/1976 | Figueras et al. | 204/286 |
| 3,950,239 | 4/1976 | Figueras | 204/254 |
| 4,309,264 | 1/1982 | Bender et al. | 204/256 |

*Primary Examiner*—Donald R. Valentine

[57] ABSTRACT

The present invention is a circular structural frame particularly suitable for use in an electrochemical cell. The frame comprises an organic plastic or metallic member with a plurality of horizontally and vertically spaced-apart shoulders protruding outwardly from opposing generally spherical anolyte and catholyte surfaces of the plastic member. Each of the shoulders annularly encircles and supports an electrically conductive insert extending from an exterior face of a shoulder on the catholyte surface of the plastic member, through the plastic member, to an exterior face of a shoulder on the anolyte surface of the plastic member.

An electrically conductive substantially completely hydraulically impermeable anolyte cover is matingly affixed to the anolyte surface of the plastic member and adapted to minimize contact between the anolyte and the plastic member. The anolyte cover is resistant to the corrosive effects of the anolyte. An electrically conductive catholyte substantially completely hydraulically impermeable cover is matingly affixed to the catholyte surface of the plastic member and adapted to minimize contact between the catholyte and the plastic member. The catholyte cover is a metal resistant to the corrosive effects of the catholyte.

The invention further includes a bipolar electrochemical cell utilizing a plurality of the above described structural frames removably and sealably positioned in a generally coplanar relationship with each other and with each of the plastic members being spaced apart at least by an anode on one side of the plastic member and a cathode on an opposing side of the plastic member.

42 Claims, 5 Drawing Figures

STRUCTURAL FRAME FOR AN ELECTROCHEMICAL CELL

BACKGROUND OF THE DISCLOSURE

This invention relates to an electrochemical cell and in particular to a circular structural frame with spherical anolyte and catholyte surfaces for use in an electrochemical cell.

It is well established that various chemicals can be produced in an electrochemical cell containing an anode and a cathode. For example, alkali metal chlorates, such as sodium chlorate, have been formed electrolytically from a sodium chloride brine in cells without a separator positioned between the anode and the cathode.

When a separator, such as a liquid permeable asbestos or polytetrafluoroethylene diaphragm or a substantially liquid impervious ion exchange membrane, is used in a cell to electrolyze a sodium chloride brine, the electrolytic products will normally be gaseous chlorine, hydrogen gas, and an aqueous solution containing sodium hydroxide.

For a number of years, gaseous chlorine has been produced in electrolytic cells wherein an asbestos diaphragm was interposed between finger like anodes and cathodes interleaved together. During the past several years it has become apparent that the use of substantially liquid impermeable cation exchange membrane may be preferable to the well established diaphragm in instances where a higher purity, for example a lower sodium chloride content, higher sodium hydroxide product is desired. It was found to be more convenient to fabricate ion exchange type electrochemical cells from relatively flat or planar sheets of ion exchange membrane rather than to interleave the membrane between the anode and cathode within the older finger like cells used with asbestos diaphragms.

The newer, so called flat plate bipolar electrochemical cells using a planar sheet of ion exchange membrane to separate the anolyte from catholyte compartments also have a plurality of solid, liquid impervious frames adapted to support the anode on one side and the cathode on the opposite side. These frames have previously been constructed of materials such as metal and plastic. Most commercial cells to date are fabricated from metal due to its superior strength qualities. In any electrochemical cell, including both monopolar and bipolar cells, there is a possibility that electrolyte may leak from within the cell to the exterior. In instances where such leakage has occurred in cells with iron or other ferrous type frames, it was found that the iron frame corroded or was itself electrolytically attacked. Flat plate plastic frames are not generally subject to the electrolytic attack, but have limitations on internal and differential pressure due to the geometry of the cell, namely the fact that it is quite thin in one dimension and quite large in the other two dimensions. This type of chamber is exposed to significant loading on the peripheral flange and center board with even modest increases in internal and/or differential pressure.

Nonrectangular cells have been attempted heretofore. As an example U.S. Pat. No. 755,247 shows nested plans in the manufacture of sulfuric acid. U.S. Pat. No. 4,309,264 shows circular planar cell members captured between facing and opposing end plates. It is submitted that maintaining a planar cell of any geometric profile, whether rectangular or circular, still exposes the center board to the same problems in handling the load which occurs internally within the cell as a result of increases in differential pressure. That is, should the cell be operated at any differential pressure level above atmospheric pressure, the large surface area of the cell exposed to the loading due to the differential pressure risks center board deflection which can damage the cation exchange membrane and can also cause shorting between adjacent cells.

It is desired to provide a structural frame for use in pressure operated electrochemical cells which would eliminate or minimize the deflection of the center board that is associated with those cell designs used by the prior art.

SUMMARY OF THE INVENTION

The present invention is a circular structural frame with spherical anolyte and catholyte surfaces particularly suitable for use in an electrochemical cell. The cell construction of this disclosure utilizes cell walls which are segments of a sphere with a plurality of horizontally and vertically spaced shoulders protruding outwardly from opposing generally spherical anolyte and catholyte surfaces of the plastic member. Each of the shoulders annularly encircles and supports an electrically conductive insert extending from an exterior face of a shoulder on the catholyte surface of the plastic member, through the plastic member, to an exterior face of a shoulder on the anolyte surface of the plastic member.

An electrically conductive, substantially completely hydraulically impermeable anolyte cover is matingly affixed to the anolyte surface of the plastic member and adapted to minimize contact between the anolyte and the plastic member. The anolyte cover is resistant to the corrosive effects of the anolyte. An electrically conductive, substantially completely hydraulically impermeable catholyte cover is matingly affixed to the catholyte surface of the plastic member and adapted to minimize contact between the catholyte and the plastic member. The catholyte cover is a metal resistant to the corrosive effects of the catholyte.

The invention further includes a bipolar electrochemical cell utilizing a plurality of the above described structural frames removably and sealable positioned in a generally coplanar relationship with each other and with each of the plastic members being spaced apart at least by an anode on one side of the plastic member and a cathode on an opposing side of the plastic member.

DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
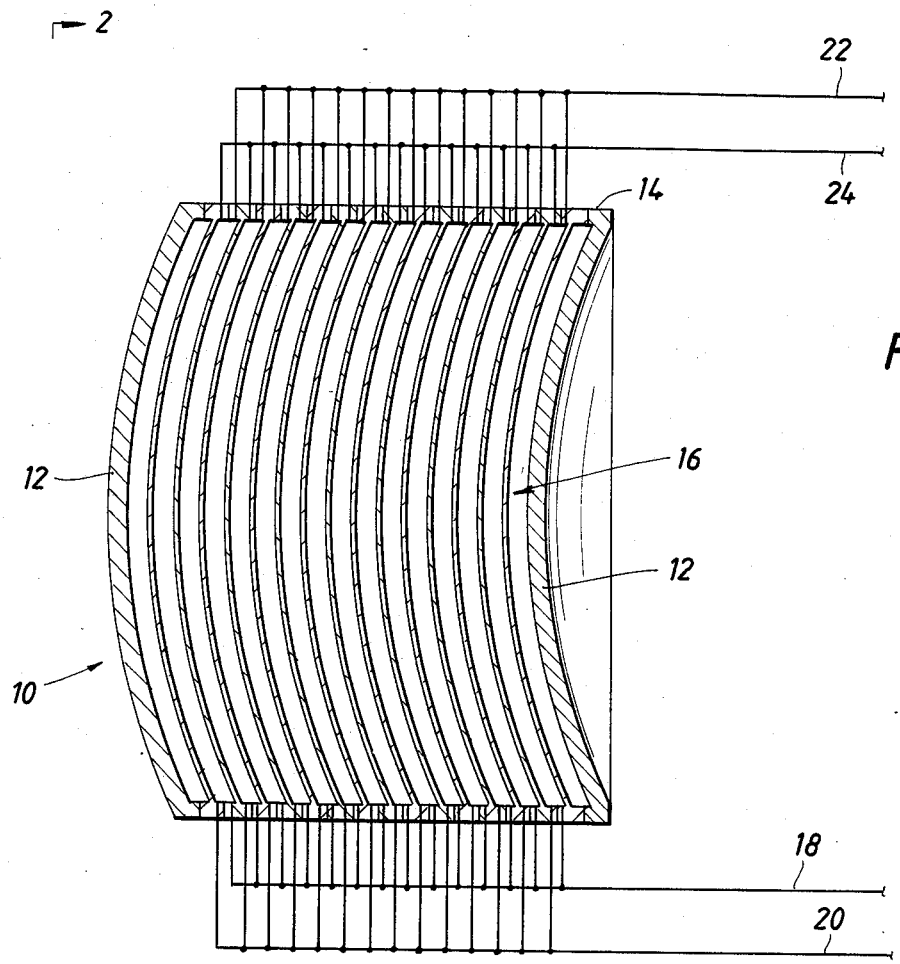
FIG. 1 is a sectional view through a set of cell walls, the cell walls being shown in section and comprising a series of segments of spheres arranged parallel to one another to define multiple adjacent cells.
Figure 2:
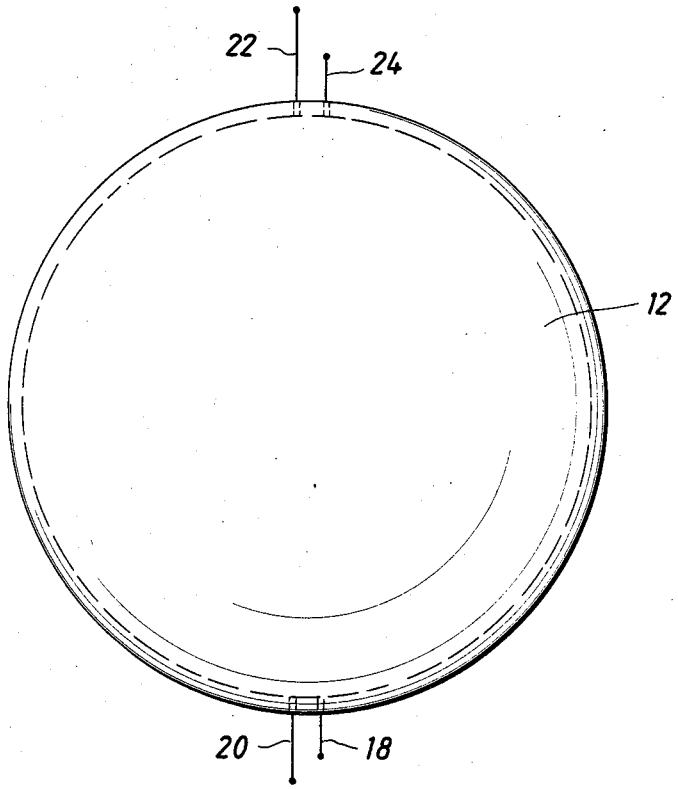
FIG. 2 is an end view of the several electrolytic cells shown in FIG. 1 showing multiple connections to the several cells for providing feed and removing the products made thereby.

Attention is directed to FIGS. 1 and 2 jointly where the numeral 10 identifies a plurality of organic plastic electrolytic cell units in stacked construction. They are identical, and a description of one will suffice for all the cell units. The structure shown in FIG. 1 comprises an entire manufacturing plant which includes the various connective lines as will be described. The detailed description of an individual cell construction will be deferred so that a description of the entire operating system can be first provided. This defines the context in which the equipment is used.

There are two large end plates of circular construction shown at 12. The plate 12 defines a structural support for the several electrolytic cells 10 comprising the assembly. This plate 12 is circular and has an encircling peripheral flange 14. The flange is located so that it connects to matching flanges of an equal diameter, thereby aiding and assisting assembly of the entire unit. The flange 14 is aligned with the additional flanges and they are held together by suitable means (not shown for the sake of clarity) thereby defining a load bearing structure. The end plates 12 support and anchor the ends of the assembly. The opposite ends of the assembly will be defined as the concave or convex ends, namely referring to the fact that the several cells curve away from or toward the plates 12.

In this improved cell construction, a barrier member is described in detail. It can be made of plastic or metal; both materials will be described. Additionally, it may be very helpful to coat one or both surfaces (the two sides are contacted by the anolyte and catholyte) to prevent corrosion. The plastic materials will be described after listing preferred metals. The barrier member can be made of iron, steel, stainless steel, nickel, aluminum, copper, chromium, magnesium, tantalum, zirconium, lead, vanadium, tungsten, iridium, rhodium, cobalt, alloys of each and alloys thereof. The preferred metal is ferrous materials where ferrous metals are primarily iron.

Many plastic materials are suitable for use in the present invention for the construction of the plastic members. Without intending to be limited by the specific organic materials hereinafter delineated, examples of such suitable materials include polyethylene; polypropylene; polyvinylchloride; chlorinated polyvinyl chloride; acrylonitrile, polystyrene, polysolfoam, styrene acrylonitrile, butadiene and styrene copolymers; epoxy; vinyl esters; polyesters; and fluoroplastics and copolymers thereof. Preferred plastic material such as polypropylene can be used for the structural member since it produces a shape with adequate structural integrity at elevated temperatures, is readily available, and is relatively inexpensive with respect to other suitable materials.

Figure 3:
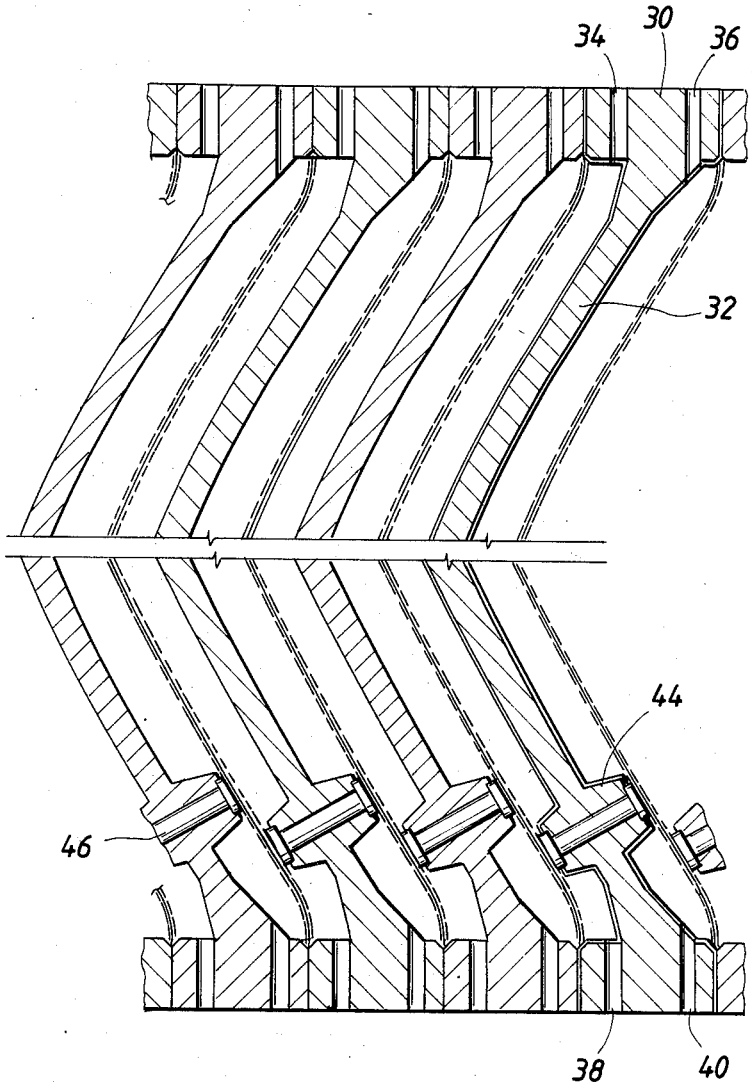
FIG. 3 is an enlarged sectional view showing details of construction of the structure and including the membrane and electrodes on opposite sides of the membrane.
Figure 4:
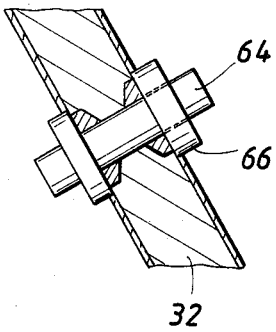
FIG. 4 is a view of an alternate construction of cell wall terminal showing details of construction; an d
Figure 5:
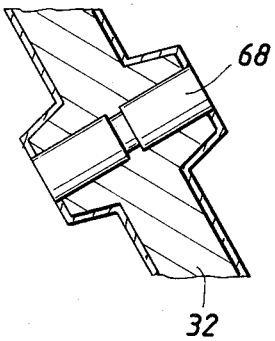
FIG. 5 is a view of an alternate construction of cell wall terminal showing details of construction.

If the barrier member is plastic, the plastic cell member is produced by any of a number of processes well known to those skilled in the plastic molding art. Such processes include injection molding, compression molding, transfer molding, and casting. Injection molding has been found to satisfactorily produce adequate strength for use in an electrochemical cell. Preferably, the plastic is injected into a mold containing the desired number of inserts 46 and covers or liners. The plastic member is a one-piece member which fits tightly around the inserts to provide a high degree of support to them. Such a configuration minimizes the likelihood that the inserts will separate from the plastic member. FIGS. 3, 4, and 5 also show metal covers placed in the mold prior to injection to enable formation of a metal lining. The lining is conductive and relatively thin. The lining is total over each face, and the inserts are covered by the linings welded to the inserts. The ease of molding relatively complex shapes and the strength of the composite injection molded article contribute to making this process preferred for making the cell 10. As will be understood, the barrier member can also be made of metal, it will first be described as a metal clad plastic body made by injection molding.

When the plastic cell member 10 is employed in an electrochemical cell for producing chlorine, the temperature of the cell and the plastic member will frequently reach, or be maintained at, temperatures of from about 60° C. to about 90° C. At these temperatures, plastics, as do most materials, expand a measurable amount. Any expansion and later contraction on cooling of the plastic frame could result in electrolyte seeping from the plurality of cells. Expansion of the plastic member 10 at one rate and expansion of metallic catholyte and anolyte covers at a different rate may set up stresses causing leakage.

To reduce, and preferably minimize the difference in expansion rates between the metallic covers and the plastic cell member 10, it is preferred to incorporate an additive to reduce thermally induced expansion of the plastic member. More preferably, the additive also increases the structural strength of the finished plastic article. Such additive can be, for example, fiberglass, graphite fibers, carbon fibers, talc, glass beads, pulverized mica, asbestos, and the like, and combinations thereof. It is preferred that the plastic contain from about 5 to about 75 weight percent and more preferably from about 10 to about 40 weight percent of the additive. Glass fibers can be readily mixed with polypropylene to produce a castable material suitable for use in the present invention which results in a solid, physically strong body with a coefficient of expansion less than polypropylene not containing glass fibers.

It has been determined that the use of commercially available polypropylene which has been specially treated to afford bonding to the glass fibers works particularly well. This results in a composite having a lower coefficient of expansion than a mixture of polypropylene and glass fibers. Such treated polypropylene fibers are available from, for example, Hercules, Inc., Wilmington, Del., as Pro-fax PCO72 polypropylene. (Pro Fax is a trademark of Hercules.)

At least one electric conducting element, such as the insert 46, is positioned and preferably molded into the plastic member 10. The insert 46 extends through the plastic member from the catholyte surface to the anolyte surface. The insert 46 is preferably retained within the plastic member 10 by means of friction between the plastic and the insert 46. It is more preferable to increase the frictional grip between these two bodies by additional means to restrain the insert 46 within the plastic cell member. Such additional means include, for example, a bolt 64 and nut 66 shown in FIG. 4.

The insert 46 can be any material which will permit flow of an electric current between the metallic catholyte liner and the metallic anolyte liner. Since the liners are metallic, it is convenient to fabricate the insert 46 from a metal, such as aluminum, copper, iron, steel, nickel, titanium, and the like, or alloys or physical combinations including such metals. The anolyte cover or liner is best titanium, tantalum, zirconium, tungsten, or alloys thereof while the catholyte cover or liner can be iron, steel, stainless, nickel, lead, molybdenum, cobalt, or alloys thereof. Preferred metals are titanium and nickel up to a few thousands of an inch thick.

The shoulders 44 adjacent the inserts should be located so they provide a fairly uniform and fairly low electrical potential gradient across the face of the electrode to which they are attached. They should be spaced so that they allow free fluid circulation within their respective electrolyte compartments. Thus, the shoulders 44 will be fairly uniformly spaced apart from one another in their respective compartments.

For purposes of description, assume that the chemical manufacturing plant utilizing the electrolytic cells 10 is a chlor-alkali unit. If that assumption is made, then each cell is provided with two feed lines. The line 18 feeds water while the line 20 provides a feed of water with NaCl. The two lines 18 and 20 are connected with various branches as shown in FIG. 1 to provide the necessary feed for each cell.

Each cell forms two gasses, namely hydrogen and chlorine. They are gathered through overhead lines and removed for compression and subsequent use. Several branches thus connect to the two dedicated lines for removal of the gasses and liquids. These two lines are identified at 22 and 24. The lines 22 and 24 deliver the liberated gasses and liquids from the cells for compression and commercial sale.

For drawing simplification, the various internal electrodes and membranes within each cell have been omitted from FIG. 1. The barrier is drawn as a metal clad metal member. It may also be plastic and can also be assumed to coated or clad. However, FIG. 3 shows greater details of this construction and includes the various electrodes. FIG. 3 shows symmetrical construction. Hence, there is an encircling peripheral flange 30 around a segment of a sphere which is identified at 32. The spherical segment is defined by a planar cut through a sphere, thereby yielding a structural member which is a true spherical portion. Moreover, this is a spherical segment of thickness typically measuring in the range of about two to three meters. This size structure can bear the loading on the dome segment resulting from increased atmospheric pressure and the risk of buckling or bowing under pressure loading is avoided by this construction.

The peripheral flange 30 is relatively thick and extends on both sides of the dome shaped member 32. A passage 34 is located on one side and a similar passage is formed at 36 at the opposite of the flange. These two outlets define passages for connection with the gas and liquid headers 22 and 24 shown in FIG. 1. In like fashion, and located diametrically oppositely, there are passages at 38 and 40 for connection with the inlet feed lines 18 and 20. While the member 30 is spherical, it defines a top and bottom by the location of the passages described. In the event metal liners are needed to protect the plastic structure from chemical attack, it may be necessary to improve the flow of DC electric current between the liners, and the insert 46. It is preferably that a material be used that is weldable to the particular cover it contacts. For example, the insert 46 may be a welded assembly of a steel rod 64 with a vanadium disk or some other intermediate material (suitable for welding titanium to steel) interposed between and welded to both the rod 64 and a titanium cup-like member on the anode facing portion of the structure. A similar nickel cuplike member may be welded directly to the rod 64 on the cathode facing portion of the insert or may also use an intermediate material to assist in improving the weld and/or electrical contact between the liner and rod 64. The titanium and nickel members are then readily weldable to the titanium anolyte cover and the nickel catholyte cover and are preferred for use in an electrochemical cell producing chlorine and an aqueous sodium hydroxide solution.

Attention is now directed to FIGS. 4 and 5. In FIG. 4, the dome 32 is again illustrated. It is fabricated without the enlargement or shoulder. There, the boss is constructed in an alternate fashion by positioning a suitable connector 64 through a drilled hole and fastening it in place with surrounding enlargements 66. This is an alternate construction to that shown in FIG. 3. Likewise, FIG. 5 shows another alternate construction wherein the connector 68 is headless. This enables the current to flow through the screen like members which comprise the anode and cathode. In FIGS. 3, 4, and 5, the barrier coating is complete, using the inserts 46, 64, and 68 to complete the surface coatings. If desired, the coating can be placed over the heads of the inserts also.

In operation, the dome shaped wall construction shown in the drawings of this disclosure enables the electrolysis cell to be operated at high pressure and higher differential pressure. For instance, considering the stack of adjacent parallel electrolysis cells shown in FIG. 1, the pressure in all of them can be increased to some high level such as two or three atmospheres with a sizable differential pressure. Because they are domed shaped, the pressure acts across the dome 32 counteracting the shaped configuration of the dome and thereby avoids deflection as a result of the dome construction. The outer periphery of each dome is anchored at the flange 30. The dome, whether loaded on the concave or convex side, does not deflect as would be the situation in a planar member. That is, a planar wall between adjacent cells will deflect on pressure loading. The dome shaped wall eliminates or minimizes the deflection. This enables the entire manufacturing plant to be operated at elevated pressure internally, with little regard to deflection of cell walls. This enables the cell wall 32 to be formed with a minimum of structural material. Its thickness can be reduced because the dome shape counteracts deflection arising from loading. The centroid of loading is at the center of each dome. Whether the loading is on the concave or convex side of the dome, no deflection occurs because loading is resisted by this construction. For convenience and installation, the end plate 12 can be included or omitted. It is especially useful in defining a planar member to be anchored against a planar foundation wall. In the foregoing, the barrier coating can be omitted or placed on one or both walls of the barrier member. Since the member can be plastic or metal, the coating is included on both types of material to obtain protection. If the materials are not subject to attack, then one or both of the coatings can be omitted.

While the foregoing is directed to the preferred embodiment, the scope is determined by the claims which follow.

What is claimed is:

1. A circular structural frame with spherical anolyte and catholyte surfaces adapted for use between electrochemical cells comprising:

(a) a cell barrier member having two opposite surfaces wherein the surfaces are generally spherical anolyte and catholyte surfaces for adjacent electrochemical cells having anodes and cathodes therein:

(b) at least one electrically conductive insert extending from the catholyte surface of said barrier member through the barrier member, and to the anolyte surface of the barrier member, wherein said barrier member supports said insert;

(c) an electrically conductive, substantially completely hydraulically impermeable anolyte cover resistant to the corrosive effects of the anolyte matingly contacted with the anolyte surface of said barrier member and adapted to minimize contact between the anolyte and said barrier member within a first cell; and (d) an electrically conductive, substantially completely hydraulically impermeable catholyte cover resistant to the corrosive effects of the catholyte matingly contacted with the catholyte surface of said barrier member and adapted to minimize contact between the catholyte and said barrier member within a second cell.

2. The frame of claim 1 wherein the anolyte cover is a metal selected from the group consisting of titanium, tantalum, zirconium, tungsten, and alloys thereof.

3. The frame of claim 1 wherein the catholyte cover is a metal selected from the group consisting of iron, steel, stainless steel, nickel, lead, molybdenum, cobalt, and alloys thereof.

4. The frame of claim 1 wherein the insert is a metal selected from the group consisting of aluminum, copper, iron, steel, nickel, titanium, and alloys thereof.

5. The frame of claim 1 wherein said anolyte and catholyte covers are attached directly to said insert.

6. The frame of claim 1 wherein the anolyte cover is titanium, or an alloy thereof;

(a) at least one insert is a ferrous-containing material; and (b) said anolyte cover is attached, by welding, to said ferrous-containing inserts through an intermediate metal which is weldable and compatible with said titanium cover and said ferrous-containing insert.

7. The frame of claim 1 wherein the said barrier member is plastic selected from the group consisting of polyethylene, polypropylene, polyvinylchloride, polystyrene, polysolfoam, styrene acrylonitrile, chlorinated polyvinylchloride, acrylonitrile, butadiene and sytrene copolymers, epoxy, vinyl esters, polyesters, and fluoroplastics.

8. The frame of claim 1 wherein said barrier member is plastic and contains an additive selected from the group consisting of fiberglass, graphite fibers, carbon fibers, talc, glass beads, asbestos, pulverized mica and poly carbonate.

9. The frame of claim 8 wherein the plastic contains from about 5 to about 75 weight percent of the additive.

10. The frame of claim 1 wherein said barrier member is plastic and contains an additive to reduce thermally induced expansion of said plastic.

11. The frame of claim 1 wherein said barrier member has a peripheral flange extending outwardly from the anolyte and the catholyte surfaces of said barrier member.

12. The frame of claim 11 wherein the flange extends outwardly from said plastic member by a distance to define cell width.

13. An electrochemical unit comprising:

a plurality of the structural frames of claim 1 removably and sealably positioned in a generally stacked relationship with each other, and each of said barrier members is spaced by an anode on one side of each of said frames and a cathode on an opposing side of each of said frames to define multiple cells.

14. The electrochemical unit of claim 13 wherein each of said anolyte and catholyte covers is welded to at least a portion of said inserts, and said anode and said cathode are welded to the respective covers at locations adjacent to said inserts.

15. The electrochemical unit of claim 14 wherein the said barrier member is plastic and is selected form the group consisting of polyethylene, polypropylene, polyvinylchloride, chlorinated polyvinylchloride, acrylonitrile, polystyrene, polysolfoam, styrene acrylonitrile, butadiene and styrene copolymers, epoxy, vinyl esters, polyesters, and fluoroplastics.

16. The barrier member of claim 14 wherein the plastic contains an additive selected from the group consisting of fiberglass, graphite fibers, carbon fibers, talc, glass beads, asbestos, and pulverized mica.

17. The barrier member of claim 16 wherein the plastic contains from about 5 to about 75 weight percent of the additive.

18. The barrier member of claim 16 wherein said plastic member has a peripheral flange extending outwardly from the anolyte and the catholyte surfaces of the plastic member.

19. The electrochemical unit of claim 13 wherein the anolyte cover is selected from the group of materials consisting of titanium, tantalum, zirconium, and tungsten.

20. The electrochemical unit of claim 13 wherein the catholyte cover is selected from the group of materials consisting of iron, steel, stainless steel, nickel, lead, molybdenum, cobalt, and alloys thereof.

21. The electrochemical unit of claim 13 wherein the insert is selected from the group of materials consisting of aluminum, copper, iron, steel, nickel, titanium, and alloys thereof.

22. The electrochemical unit of claim 13 wherein said anolyte and catholyte covers are welded directly to said insert.

23. The electrochemical unit of claim 13 wherein the anolyte cover is titanium or n alloy thereof, said insert is a ferrous-containing material and a vanadium disk is positioned between, and welded to, said anolyte liner and said insert.

24. The electrochemical unit of claim 13 wherein the plastic contains an additive to reduce thermally induced expansion of said plastic member.

25. The electrochemical unit of claim 13 wherein said plastic member has a peripheral flange extending outwardly from the anolyte and the catholyte surfaces of said plastic member.

26. The electrochemical unit of claim 25 wherein the flange extends outwardly from the plastic member about the same distance as said inserts.

27. A structural frame adapted for use in first and second chlor-alkali electrolytic cells for producing gaseous chlorine and an aqueous alkali metal hydroxide solution from an aqueous alkali metal chloride brine comprising:

(a) a glass filled polypropylene member with a plurality of horizontally and vertically spaced shoulders protruding outwardly from opposing generally coplanar anolyte and catholyte surfaces of said polypropylene member;

(b) at least one electrically conductive steel insert extending through said polypropylene member and axially aligned with a shoulder on each opposing surfaces of said polypropylene member;

(c) a substantially completely hydraulically impermeable, titanium anolyte cover matingly affixed to the anolyte surface of said polypropylene member and adapted to minimize contact between the anolyte and said polypropylene member within a first cell; and (d) a substantially completely hydraulically impermeable, nickel catholyte cover matingly affixed to the catholyte surface of said polypropylene member and adapted to minimize contact between the catholyte and said polypropylene member within a second cell.

28. Apparatus, comprising:

(a) a plurality of similar electrolytic cells, each enclosing:

(1) a central membrane, (2) spaced parallel anode and cathode electrodes sandwiched around said membrane;

(b) a surrounding marginal edge to said cells formed of structurally reinforced means;

(c) barrier means positioned between adjacent cells within said surrounding marginal edge and further having opposing faces confronting adjacent cells; and (d) said barrier means having a shape defined by a segment of a spherical surface.

29. The apparatus of claim 28 wherein said structurally reinforced means comprises a ring shaped, circular protruding flange serving as anchor means for said electrodes anchored thereto.

30. The apparatus of claim 28 wherein said marginal edge is formed of a stack of nestable, ring shaped members, each having spaced parallel circular faces to enable nesting and wherein said central membrane includes a circular outer edge clamped between two nested ring shaped members.

31. The apparatus of claim 30 including holes formed in said ring shaped members to enable inlet lines to connect from the exterior to the interior of said ring shaped members.

32. The apparatus of claim 28 including first and second spaced electrically insulative coatings adjacent opposite faces of said barrier means.

33. The apparatus of claim 28 wherein said barrier means includes an electrical feed through for providing current flow through said electrolytic cells, said feed through having the form of an electrically insulated current conducting member through said barrier means.

34. The apparatus of claim 33 including means sealing and feed through against liquid flow therealong.

35. The apparatus of claim 28 wherein said barrier means comprises a segment of a spherical surface having a circular outer edge terminating in a ring shaped circular flange.

36. The apparatus of claim 28 wherein said barrier means is metal selected from the group consisting of iron, steel, stainless steel, nickel, aluminum, copper, chromium, magnesium, tantalum, zirconium, lead, vanadium, tungsten, iridium rhodium, coball, and alloys thereof.

37. The apparatus of claim 28 wherein said barrier means is metal clad over a base member and said base member is metal or plastic.

38. The apparatus of claim 28 wherein said barrier means is primarily ferrous materials or alloys thereof.

39. An electrolysis manufacturing plant adapted to be connected to a voltage source for manufacture of chemicals by current flow therethrough comprising multiple similar electrolytic cells separated from adjacent electrolytic cells by a dividing wall having (1) an outer periphery in a first plane, and (2) a spherical surface between adjacent cells, said wall being defined by a curving line at a plane intersecting said wall perpendicular to the first plane and wherein said wall isolates within cells adjacent to said wall electrodes and membranes for the cells adjacent to said wall.

40. The apparatus of claim 39 further including means spacing said electrodes and membrane from said cell wall having the form of electrically insulated spacer ribs.

41. The apparatus of claim 39 wherein said wall in side view is circular and in sectional view is an arc of a circle.

42. The apparatus of claim 41 including an end located mounting plate attached to said plant and having a conforming circular mounting flange.

* * * * *